United States Patent [19]

Hürlemann et al.

[11] Patent Number: 4,676,017

[45] Date of Patent: Jun. 30, 1987

[54] APPARATUS FOR EJECTION OF EMPTY CARTRIDGE CASES FROM AN AUTOMATIC FIRING WEAPON

[75] Inventors: Ernst Hürlemann; Werner Bosshard; Werner Stauffacher, all of Zurich, Switzerland

[73] Assignee: Werkzeugmaschinenfabrik Oerlikon-Bührle AG, Zurich, Switzerland

[21] Appl. No.: 818,228

[22] Filed: Jan. 13, 1986

[30] Foreign Application Priority Data

Jan. 25, 1985 [CH] Switzerland ..... 345/85

[51] Int. Cl.[4] ..... F41C 15/00; F41D 10/00

[52] U.S. Cl. ..... 42/25

[58] Field of Search ..... 42/25

[56] References Cited

U.S. PATENT DOCUMENTS 1,401,552 12/1921 Pederson ..... 42/25
2,412,663 11/1944 Williams ..... 42/25
3,057,100 10/1962 Dixon ..... 42/25
3,680,242 8/1972 Wiese ..... 42/25

FOREIGN PATENT DOCUMENTS 107970 7/1898 Fed. Rep. of Germany ..... 42/25
280136 11/1927 United Kingdom ..... 42/25

*Primary Examiner*—Deborah L. Kyle
*Assistant Examiner*—Michael J. Carone
*Attorney, Agent, or Firm*—Werner W. Kleeman

[57] ABSTRACT

Before the empty cartridge case is ejected it is extracted from the cartridge chamber of the weapon barrel by an extractor and subsequently tilted by an ejector. During this operation large forces are exerted on the pivotably mounted extractor. It has been found that when high cadence firing takes place the spring forces are too small to hold the extractor reliably. Therefore, the extractor is secured by a support lever or by a locking pawl against inadvertent pivoting during the removal of the cartridge case. Preferably a support lever or support slide is arranged in the breechblock to prevent premature tilting of the cartridge case.

12 Claims, 4 Drawing Figures

APPARATUS FOR EJECTION OF EMPTY CARTRIDGE CASES FROM AN AUTOMATIC FIRING WEAPON

BACKGROUND OF THE INVENTION

The present invention broadly relates to a new and improved construction of an apparatus for ejecting empty cartridge cases from an automatic firing weapon.

In its more particular aspects, the present invention relates to a new and improved construction of an apparatus for ejecting empty cartridge cases from an automatic firing weapon with an extractor lever which engages in an extraction groove of the cartridge case and is pivotably mounted in the breechblock of the firing weapon. The apparatus further possesses an ejector which is movably arranged in the breechblock and is pushed against the base of the cartridge case for ejecting the cartridge case. The apparatus also possesses a spring which has the tendency to bring the extractor lever into engagement with the extraction groove of the cartridge case.

Numerous ejector apparatuses of this type are known, such as for example the constructions known from the Swiss Pat. No. 627,264. In this Swiss patent there is described a breechblock for an automatic firing weapon, which automatic firing weapon possesses a breechblock housing in which there is situated a breechblock body. An extractor is pivotably mounted on this breechblock body and an ejector is displaceably guided therein. During the firing operation the breechblock body reciprocates or moves forward and backward. An extractor, which is constructed as a two-armed lever, is rotatably mounted on a shaft or journal in a slot of the breechblock body. A spring engages at the rear end of the extractor. The front end of the extractor, which is designated as a claw, engages into the extractor groove of the cartridge case under the effect of the spring.

During high cadence firing the forces which the ejector exerts on the claw of the extractor during ejection of cartridge cases are so high that the force of the spring which pushes the extractor with the claw into the extractor groove of the cartridge case is no longer adequate. Further measures are necessary in order to ensure that the extractor with the claw can grasp the cartridge case with such certainty that the cartridge case will be tilted when being ejected by the ejector.

SUMMARY OF THE INVENTION

Therefore, with the foregoing in mind, it is a primary object of the present invention to provide a new and improved construction of an apparatus for ejection of empty cartridge cases from an automatic firing weapon which does not exhibit the aforementioned drawbacks and shortcomings of the prior art construction.

A further important object of the invention is the provision of a reliable ejector apparatus which can guarantee a reliable ejection of the empty cartridge cases from the firing weapon even under high cadence firing and correspondingly high forces.

Now in order to implement these and still further objects of the invention, which will become more readily apparent as the description proceeds, the apparatus for ejecting empty cartridge cases from an automatic firing weapon is manifested by the features that at least in the rearmost position of the breechblock the extractor lever is secured against unintentional or inadvertent pivoting by means of a safety component, such as a support lever or locking or latching pawl.

Preferably the support lever is pivotably mounted in the breechblock and, in the rearmost position of the breechblock, bears on or rests against a latch or stop of the weapon housing. Thus, the extractor lever is secured against unintentional or inadvertent pivoting.

In a further preferred embodiment of the invention a locking or latching pawl is pivotably mounted in the breechblock and is held in its locking or latching position by means of a spring. Thus, also the extractor lever is secured against unintentional or inadvertent pivoting. In the foremost position of the breechblock the locking pawl is released by means of a control cam.

In yet a further preferred exemplary embodiment of the invention the cartridge case is secured against unintentional or inadvertent tilting by means of a support lever or a support slide arranged on a breechblock. The support lever or support slide can be pivoted by means of control components out of a support position into a release position, in which release position the cartridge case can be tilted. It is preferable for the support slide or slide member to be movable into its support position by means of a spring and to be displaceable into its release position against the force of such spring by means of a latch or stop in the weapon housing.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
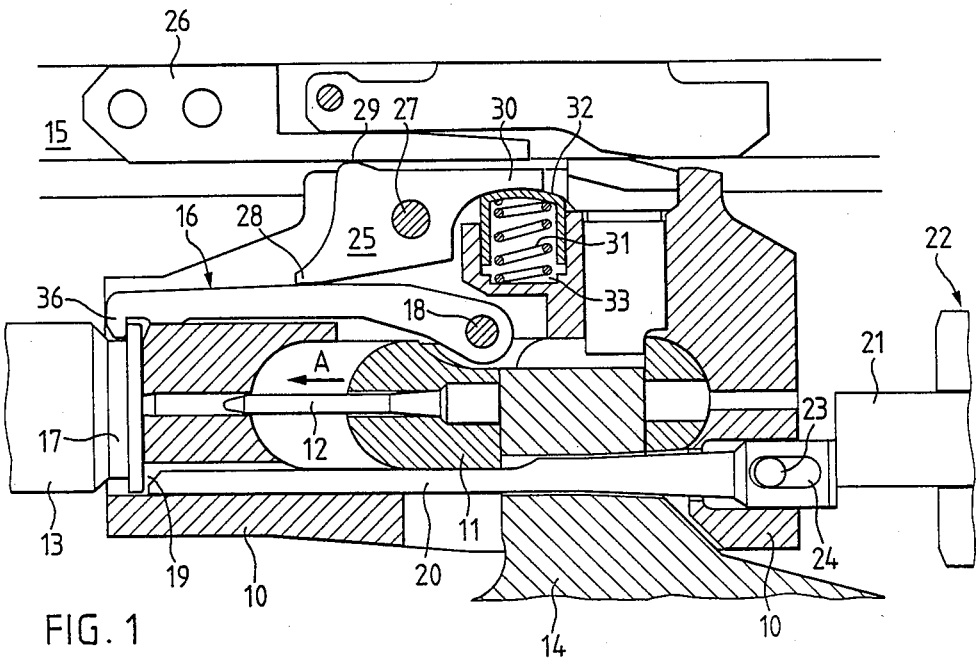
FIG. 1 shows a longitudinal section through a portion of a weapon housing of an apparatus for ejecting empty cartridge cases from an automatic firing weapon, with a breechblock, a cartridge extractor, a cartridge ejector and, in accordance with a first exemplary embodiment of the invention, with a support lever for the cartridge extractor.

Describing now the drawings, it is to be understood that to simplify the showing thereof only enough of the structure of the apparatus for ejecting empty cartridge cases from an automatic firing weapon has been illustrated therein as is needed to enable one skilled in the art to readily understand the underlying principles and concepts of this invention. Turning now specifically to FIG. 1 of the drawings, there is shown in a first exemplary embodiment of the invention a breechblock 10 and a displaceably guided control element 11. A firing pin 12 for piercing a cartridge 13 is fastened to this control element 11. Only the rear end of the cartridge or cartridge case 13 is visible. A carrier or entrainment member 14 projects into a recess of the control element 11 and by means of a not particularly shown recoil spring this carrier 14 displaces the control element 11 and the breechblock 10 out of the position illustrated in FIG. 1 forwards in the direction of the arrow A, i.e. in the direction of firing of the weapon. However, this displacement is considered to be known per se and therefore is not here further described.

It will be appreciated that in this above-described action the cartridge or cartridge case 13 is inserted into a not particularly shown weapon barrel. The breechblock 10 is locked or latched in its foremost position by a control member or cam in a weapon housing 15 with the assistance of not particularly shown latch pins or bolts and then the cartridge 13 is pierced by the firing pin 12. Thereupon the cartridge case 13 must be extracted from the weapon barrel. For this purpose a pivotably mounted extractor lever 16 engages with an extractor groove 17 of the cartridge case 13. The extractor lever 16 is pivotably mounted about a pin or journal 18 in the breechblock 10. This pivotability is necessary in order that the cartridge 13 can at all arrive in a recess 19 of the breechblock 10. The mode of cartridge insertion or supply is also considered to be known per se and is therefore not here further described.

An ejector rod or pin 20 serves for ejecting the empty cartridge case 13. This ejector rod or pin 20 projects through a longitudinal bore or hole of the breechblock 10. In the depicted position at its rear, the ejector rod or pin 20 rests or abuts against a piston 21 of a breechblock buffer or bumper 22. The breechblock buffer 22 is secured or fastened in the weapon housing 15 in a suitable not further described manner. The stroke of the ejector rod or pin 20 is limited by means of a pin or journal 23 which is fastened in the breechblock 10 and protrudes through an elongated hole 24 of the ejector rod or pin 20. During the return motion of the breechblock 10 the ejector rod or pin 20 impacts against the piston 21 of the breechblock buffer 22 and consequently with its front end is pushed against the base of the cartridge case 13, causing the cartridge case 13 to tilt and be ejected in a manner known per se.

The extractor lever 16 must retain the cartridge case 13 during this tilting movement so that the cartridge case 13 can be properly tilted. In other words, during the tilting process of the cartridge case 13, the extractor lever 16 may not be pivoted. It has been shown that during this tilting movement of the cartridge case 13 large forces are transmitted to the extractor lever 16. Therefore the extractor lever 16 is supported by a support lever 25 against a latch or stop 26 which is stationarily secured or fastened in the weapon housing 15. This support lever 25 is pivotably mounted in the weapon housing 15. The support lever 25 is further pivotable about a pin or journal 27 and possesses a projection 28 which abuts or makes contact with the extractor 16.

Furthermore, the support lever 25 possesses a latch or stop surface 29 which abuts or makes contact with the latch or stop 26, and an arm 30 which supports a spring 31 via a spring housing 32. The spring 31 is situated in a blind hole 33 of the breechblock 10. The extractor lever 16 cannot pivot as long as the latch or stop surface 29 of the support lever 25 is supported against the latch or stop 26. Only when the breechblock 10 moves forwards and the latch or stop surface 29 is no longer in the region of the latch or stop 26 can the support lever 25 and the extractor lever 16 pivot in a clockwise direction, compressing the spring 31. Therefore in the depicted position of the breechblock 10 a reliable tilting and ejection of the empty cartridge case 13 is assured due to the fact that the extractor lever 16 is secured.

Figure 2:
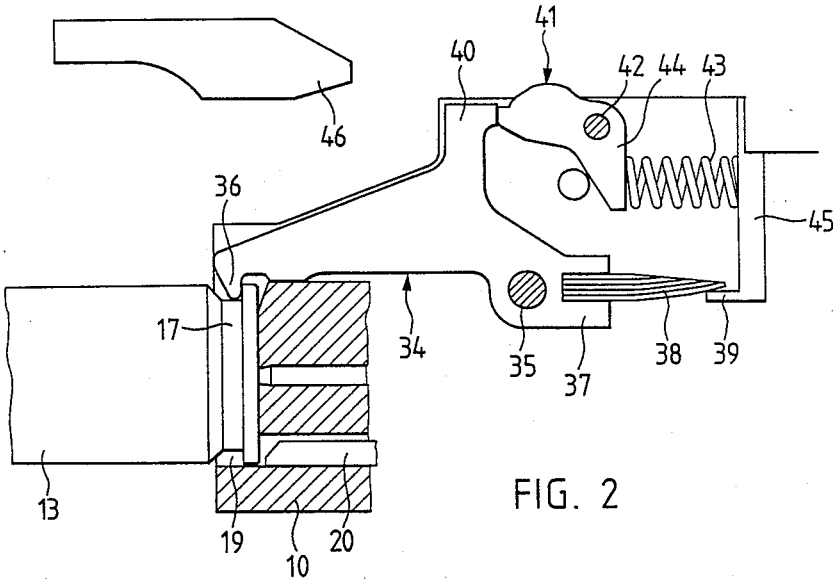
FIG. 2 shows a longitudinal section of a portion of the breechblock with an extractor and a locking pawl in accordance with a second exemplary embodiment of the invention.

In a second exemplary embodiment in accordance with FIG. 2 an extractor lever 34 is pivotably mounted about a pin or journal 35 in the breechblock 10 and, in the depicted position, engages with a projection 36 into the extractor groove 17 of the cartridge case 13. The extractor lever 34 further possesses a fork 37 in which there is fastened a leaf spring 38 which, in turn, is supported by or rests upon a latch or stop 39 of the breechblock 10. The leaf spring 38 has the tendency to pivot the extractor lever 34 into the depicted position. In other words, the extractor lever 34 can only be pivoted in a clockwise direction about the pin or journal 35 against the force of the leaf spring 38. Furthermore, the extractor lever 34 possesses an arm 40, which in the drawing is directed upwards and which is supported by or rests against a locking pawl 41. The locking pawl 41 is likewise pivotably mounted about a pin or journal 42 in the breechblock 10.

A spring 43 is supported on one side against an arm 44 of the locking pawl 41 and on the other side against a wall member or cantilever member 45 of the breechblock 10. The spring 43 has the tendency to pivot the locking pawl 41 in a clockwise direction into the depicted position in which the arm 40 of the extractor lever 34 is supported or rests. In this position of the locking pawl 41 the extractor lever 34 is secured against rotation in a clockwise direction. This security or securing action is independent of the force of the spring 43 due to the fact that the force which the arm 40 of the extractor lever 34 exerts on the locking pawl 41 is taken up or absorbed by the pin or journal 42. A control cam 46 which is secured or fastened to the weapon housing 15 serves for the release of the extractor lever 34. As soon as the breechblock 10 reaches a foremost position in the weapon housing 15 the locking pawl pushes against the control cam 46 and is pivoted in a counterclockwise direction against the force of the spring 43, whereby the arm 40 of the extractor lever 34 is released. In this foremost position of the breechblock 10 the extractor lever 34 can be pivoted so far in the clockwise direction that a cartridge 13 can arrive in the recess 19.

This second exemplary embodiment, in accordance with FIG. 2, is differentiated from the first exemplary embodiment, in accordance with FIG. 1, essentially in that the extractor lever 34 is secured or locked during the forward and backward movement of the breechblock 10 and is unsecured or unlocked in the foremost position. In the first exemplary embodiment the extractor lever 16 is only secured or locked in the rearmost position of the breechblock 10.

Figure 3:
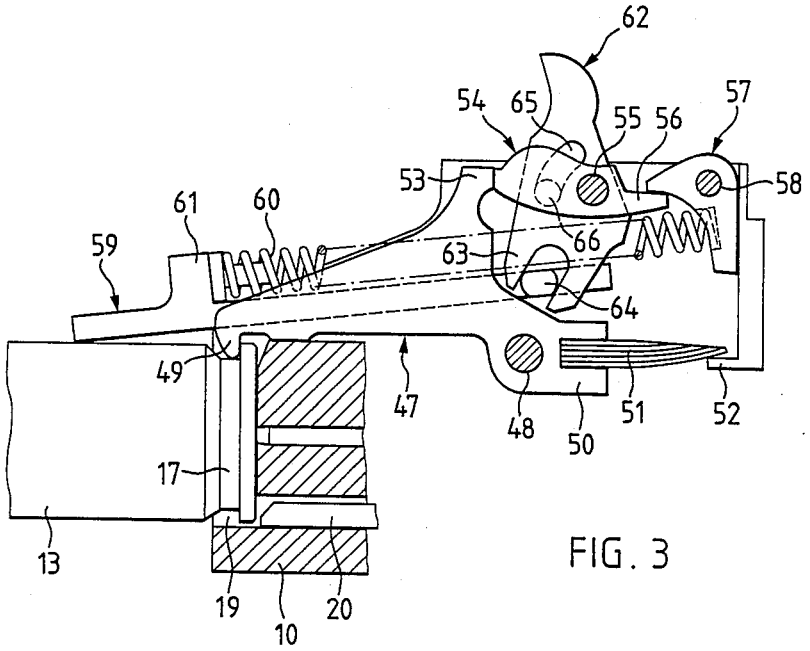
FIG. 3 shows a longitudinal section of a portion of the breechblock with an extractor, a locking pawl and a support slide, in accordance with a third exemplary embodiment of the invention.

In a third exemplary embodiment in accordance with FIG. 3 an extractor lever 47 is pivotably mounted about a pin or journal 48 in the breechblock 10, and in the depicted position engages with a projection 49 thereof into the extractor groove 17 of the cartridge case 13. The extractor lever 47 possesses a fork 50 in which there is fastened or secured a leaf spring 51 which is supported by or rests upon a latch or stop of the breechblock 10. The leaf spring 51 has the tendency to pivot the extractor lever 47 into the depicted position. Therefore, the extractor lever 47 can only be pivoted against the force of the leaf spring 51 in a clockwise direction about the pin or journal 48. Furthermore, the extractor lever 47 possesses an arm 53 which in FIG. 3 is upwardly directed and which is supported by or abuts against a locking or latching pawl 54. The locking pawl 54 is also pivotably mounted about a pin or journal 55 in the breechblock 10 and is supported by or abuts against a pawl 57 through an arm 56. The pawl 57 is also mounted about a pin or journal 58 in the breechblock 10. Furthermore, a support slide 59 is displaceably guided in a bore or hole in the breechblock 10. The purpose of this support slide 59 is to prevent an undesired premature tilting of the cartridge case 13.

A spring 60 is supported on one side on a stop 61 of the support slide 59 and on the other side on the pawl 57. The spring 60 has the tendency to press the support slide 59 against the cartridge case 13 and to pivot the pawl 57 in a counterclockwise direction, causing the pawl 57 to abut or rest on the arm 56 of the locking pawl 54. In addition to the locking pawl 54, there is also mounted on the pin or journal 55 a two-armed operating lever 62 which possesses a fork 63. A cam 64 of the support slide 59 engages in the fork 63. Furthermore, the operating lever 62 possesses a curved slot 65 in which a pin or slide 66 of the locking pawl 54 engages. The locking pawl 54 can be pivoted by means of a not particularly shown control cam when the breechblock 10 is in its foremost position. This pivoting enables or releases the extractor lever 47 in a manner analagous to the second exemplary embodiment. Furthermore, the operating lever 62 can be pivoted in the rearmost position of the breechblock 10 by means of a second not particularly shown control cam. This pivoting action retracts or pulls back the support slide 59 so that the cartridge case 13 can be tilted. The ejector rod or pin 20 depicted and described in FIG. 1 serves for tilting the cartridge case 13.

Figure 4:
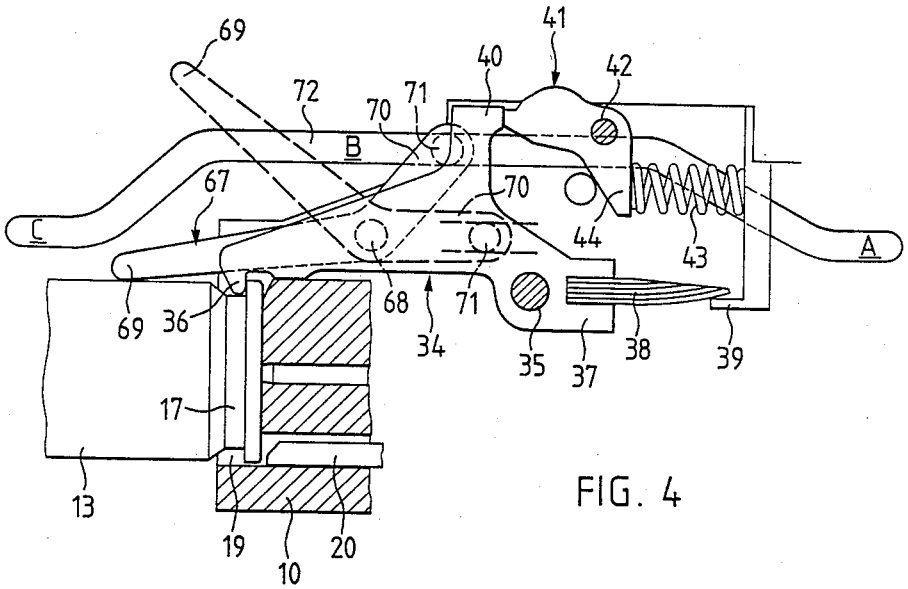
FIG. 4 shows a longitudinal section of a portion of the breechblock with an extractor, a locking pawl and a cartridge support lever, in accordance with a fourth exemplary embodiment of the invention.

In the fourth exemplary embodiment in accordance with FIG. 4 the extractor lever 34 is constructed in exactly the same way as in the second exemplary embodiment in accordance with FIG. 2. The extractor lever 34 is pivotably mounted about the pin or journal 35 in the breechblock 10 and in the depicted position engages with its projection 36 into the extractor groove 17 of the cartridge case 13. The extractor lever 34 further possesses a fork 37 in which there is secured or fastened a leaf spring 38 which is supported by or rests upon a latch or stop 39 of the breechblock 10. The leaf spring 39 has the tendency to pivot the extractor lever 34 into the depicted position. However, instead of the support slide 59 depicted in FIG. 3, in the fourth exemplary embodiment in accordance with FIG. 4, a support lever 67 is pivotably mounted about a pin or journal 68 in the breechblock 10. This support lever 67 possesses a first arm 69 and a second arm 70 of which the first arm 69 abuts against or rests upon the cartridge case 13 and secures the cartridge case 13 against premature tilting. The second arm 70 possesses a pin 71 which engages in a control groove 72 of the weapon housing 15.

As long as the pin 71 of the support lever 67 is situated in either of both sections or regions A and C at the start and end of the control groove 72, i.e. when the breechblock 10 is situated in its rearmost or foremost position, the support lever 67 takes up the position as drawn with dashed lines in FIG. 4. However, if the pin 71 of the support lever 67 is situated in the center section or region B of the control groove 72, i.e. while the breechblock 10 moves from one end position to the other, the support lever 67 takes up the position as drawn with solid lines in FIG. 4 and the cartridge case 13 is secured against unintentional or inadvertent tilting.

The method of operation of the apparatus for ejection of empty cartridge cases from an automatic firing weapon as described above is as follows:

In a not here particularly shown manner a cartridge is laterally fed or supplied in accordance with FIG. 1, and is inserted into the weapon barrel by the action of the breechblock 10. Consequently, the rear end or base of the cartridge case 13 arrives in the recess 19 of the breechblock 10 and the projection 36 of the extractor lever 16 engages in the extractor groove 17 of the cartridge case 13. Subsequently the control element 11 is also displaced in the breechblock 10 by means of the carrier or entrainment member 14 and the firing pin 12 will pierce the cartridge. After the firing operation the breechblock 10 is moved backwards by the gas pressure and the cartridge case 13 is extracted out of the weapon barrel by the extractor or the extractor lever 16. It is not necessary to secure the extractor lever 16 against pivoting for this process.

However, as soon as the breechblock 10 strikes or impacts against the breechblock buffer 22, the ejector rod or pin 20 is pushed against the cartridge case 13 by means of the piston 21 in order to tilt the cartridge case 13. However, during this process it is necessary to secure the extractor lever 16 against unintentional or inadvertent pivoting. During the rearward movement of the breechblock 10 the support lever 25 strikes or impacts against the latch or stop 26, the projection 28 of the support lever 25 is pressed against the extractor lever 16 and the extractor lever 16 can no longer pivot. Thus a reliable tilting of the cartridge case 13 is assured.

The method of operation of the second, third and fourth exemplary embodiments, in accordance with FIGS. 2 to 4, respectively, differs with respect to the first exemplary embodiment, in accordance with FIG. 1, in that the extractor lever 34 of FIG. 2 or the extractor lever 47 of FIG. 3 is constantly in contact with or supported by the locking pawl 41 or 54. Only in the foremost position of the breechblock 10 is the locking pawl 41 pivoted by the control cam 46 and the extractor lever 34 or 47 is released. Thus, the cartridge case 13 can engage or enter into the recess 19 of the breechblock 10 and the extractor lever 34 or 47 can engage in the extractor groove 17 of the cartridge case 13. The cartridge case 13 is secured against unintentional or inadvertent tilting by means of the support lever 67 as shown in FIG. 4 or by means of the support slide 59 as shown in FIG. 3, and only in the rearmost position of the breechblock 10 is the cartridge case 13 released for tilting by means of the support lever 67 or the support slide 59.

In accordance with FIG. 3 the operating lever 62 is pivoted by means of not particularly shown control cams and the support slide 59 is pulled back. In accordance with FIG. 4 the pin 71 of the support lever 67 arrives in the section or region A of the control groove 72 and the support lever 67, with its arms 69, is pivoted away from the cartridge case 13.

While there are shown and described present preferred embodiments of the invention, it is to be distinctly understood that the invention is not limited thereto, but may be otherwise variously embodied and practiced within the scope of the following claims.

Accordingly, what we claim is:

1. An apparatus for ejecting an empty cartridge case from an automatic firing weapon having a weapon housing and into which a cartridge having a cartridge case having a base and an extractor groove is inserted by means of a breechblock reciprocatingly movable between a foremost and a rearmost position, comprising:

an extractor lever pivotably mounted in said breechblock and engaging said extractor groove of said cartridge case;

an ejector rod movably arranged in said breechblock and bearing against the base of said cartridge case for ejecting said cartridge case;

security means for securing said extractor lever against inadvertent pivoting out of said engagement with said extractor groove of said cartridge case; and said security means containing a separate pivotable spring-loaded support member cooperating with said extractor lever and mounted at said breechblock and stop means cooperating with said spring-loaded support member and arranged in said weapon housing.

2. The apparatus as defined in claim 1, wherein:

said separate pivotable spring-loaded support member comprises a spring-loaded support lever;

said stop means being arranged in said weapon housing at least in the region of the rearmost position of the breechblock; and said stop means being arranged in said weapon housing such that said spring-loaded support lever is held in engagement with said extractor lever and thereby secures said extractor lever against said inadvertent pivoting at least in the rearmost position of said breechblock.

3. The apparatus as defined in claim 1, wherein:

said separate pivotable spring-loaded support member comprises a spring-loaded locking pawl;

said spring-loaded locking pawl engaging said extractor lever and thereby securing said extractor lever against said inadvertent pivoting at least in the rearmost position of said breechblock;

said stop means being arranged in said weapon housing substantially in the region of the foremost position of the breechblock; and said stop means being arranged in said weapon housing such that said spring-loaded locking pawl is disengaged from said extractor lever in order to render said extractor lever pivotable under the action of a cartridge substantially in the foremost position of said breechblock.

4. The apparatus as defined in claim 3, further including:

a spring;

said spring loading said extractor lever into engagement with said extractor groove of said cartridge case;

a control cam constituting said stop means; and means for pivotably mounting said spring-loaded locking pawl in said breechblock such as to be pivotable into engagement with said extractor lever.

5. The apparatus as defined in claim 4, further including:

support means;

said weapon housing having a control groove; and said support means being mounted on said breechblock such that said cartridge case is secured against said inadvertent pivoting during displacement of said breechblock between the foremost and the rearmost position of said breechblock, and said support means being pivotable by means of said control groove out of a supporting position in which said support means engage said cartridge case, into a release position in which said support means are disengaged from said cartridge case.

6. The apparatus as defined in claim 5, wherein:

said support means comprises a support lever.

7. The apparatus as defined in claim 4, further including:

support means comprising a support slide; and said support slide being mounted on said breechblock such that said cartridge case is secured against said inadvertent pivoting during displacement of said breechblock between the foremost and the rearmost position of said breechblock.

8. The apparatus as defined in claim 7, further including:

said support slide having a supporting position in which said support slide engages said cartridge case and a release position in which said support slide is disengaged from said cartridge case;

a further spring spring-loading said locking pawl as well as said support slide; and said support slide being translatable into said supporting position under the force of said further spring.

9. An apparatus for ejecting an empty cartridge case from an automatic firing weapon having a weapon housing and into which a cartridge having a cartridge case having a base and an extractor groove is inserted by a breechblock, comprising:

an extractor lever pivotably mounted in said breechblock and engaging said extractor groove of said cartridge case;

an ejector rod movably arranged in said breechblock and bearing against the base of said cartridge case for ejecting said cartridge case;

a spring for bringing said extractor lever into engagement with said extractor groove of said cartridge case;

security means for securing said extractor lever against inadvertent pivoting at least in a rearmost position of said breechblock;

said security means comprising a locking pawl;

a further spring;

a control cam;

means for pivotably mounting said locking pawl in said breechblock and having an engaged position therein;

said further spring maintaining said locking pawl in said engaged position such that said extractor lever is secured against inadvertent pivoting;

said extractor lever, having an unlocked position;

said control cam bringing said extractor lever into said unlocked position in a foremost position of said breechblock;

support means;

said weapon housing having a control groove; and said support means being mounted on said breechblock such that said cartridge case is secured against inadvertent tilting, and said support means being pivotable out of a supporting position into a release position by means of said control groove.

10. The apparatus as defined in claim 9, wherein:

said support means comprises a support lever.

11. An apparatus for ejecting an empty cartridge case from an automatic firing weapon having a weapon housing and into which a cartridge having a cartridge case having a base and an extractor groove is inserted by a breechblock, comprising:

an extractor lever pivotably mounted in said breechblock and engaging said extractor groove of said cartridge case;

an ejector rod movably arranged in said breechblock and bearing against the base of said cartridge case for ejecting said cartridge case;

a spring for bringing said extractor lever into engagement with said extractor groove of said cartridge case;

security means for securing said extractor lever against inadvertent pivoting at least in a rearmost position of said breechblock;

said security means comprising a locking pawl;

a further spring;

a control cam;

means for pivotably mounting said locking pawl in said breechblock and having an engaged position therein;

said further spring maintaining said locking pawl in said engaged position such that said extractor lever is secured against inadvertent pivoting;

said extractor lever, having an unlocked position;

said control cam bringing said extractor lever into said unlocked position in a foremost position of said breechblock;

support means;

said support means being mounted on said breechblock such that said cartridge case is secured against inadvertent tilting, and said support means being pivotable out of a supporting position into a release position; and said support means comprising a support slide.

12. The apparatus as defined in claim 11, further including:

stop means arranged on said weapon housing;

said support slide having a supporting position and a release position;

said support slide being translatable into said supporting position by means of said further spring; and said support slide being displaceable into said release position against the force of said further spring by means of said stop means.

* * * * *